US009254991B2

(12) United States Patent
Ekström et al.

(10) Patent No.: US 9,254,991 B2
(45) Date of Patent: Feb. 9, 2016

(54) FILLING MACHINE WITH SEALING VALVE

(75) Inventors: Jan-Erik Ekström, Höör (SE); Bo Runnberg, Smedstorp (SE); Henrik Brännmo, Staffanstorp (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 930 days.

(21) Appl. No.: 13/508,170

(22) PCT Filed: Oct. 26, 2010

(86) PCT No.: PCT/SE2010/000256

§ 371 (c)(1),
(2), (4) Date: Jun. 6, 2012

(87) PCT Pub. No.: WO2011/056114

PCT Pub. Date: May 12, 2011

(65) Prior Publication Data

US 2012/0241046 A1 Sep. 27, 2012

(30) Foreign Application Priority Data

Nov. 6, 2009 (SE) ..... 0901417

(51) Int. Cl.
*B65B 1/04* (2006.01)
*B67C 3/00* (2006.01)
*B65B 39/00* (2006.01)

(52) U.S. Cl.
CPC ..... *B67C 3/004* (2013.01); *B65B 39/004* (2013.01); *B65B 2210/06* (2013.01); *B65B 2210/08* (2013.01)

(58) Field of Classification Search
CPC ..... B67C 3/002; B67C 3/004; B65B 39/004; B65B 2210/06; B65B 2210/08
USPC ..... 141/90
See application file for complete search history.

(56) References Cited

U.S. PATENT DOCUMENTS

| | | | | |
|---|---|---|---|---|
| 4,534,494 | A | 8/1985 | Hautemont | |
| 5,562,129 | A | 10/1996 | Graffin | |
| 2009/0095370 | A1* | 4/2009 | Krulitsch | 141/6 |
| 2010/0132834 | A1* | 6/2010 | Clusserath et al. | 141/115 |

FOREIGN PATENT DOCUMENTS

DE 202006006149 U1 7/2007

OTHER PUBLICATIONS

International Search Report (PCT/ISA/210) issued on Feb. 28, 2011, by the Swedish Patent Office as the International Searching Authority for International Application No. PCT/SE2010/000256.

* cited by examiner

*Primary Examiner* — Jason K Niesz
(74) *Attorney, Agent, or Firm* — Buchanan Ingersoll & Rooney PC

(57) ABSTRACT

A filling machine for filling product into a packaging container comprises;

at least one filling nozzle for ejection of liquid in a first general direction into the packaging container, wherein the filling nozzle is arranged in a dishbox having an opening through which the product may be ejected towards a package provided in a volume, wherein the opening may selectively be sealed by a sealing valve having a valve body with a portion dimensioned to be inserted in said opening. In the inventive filling machine a recess is arranged in an upper surface of the volume such that the valve body is at least partly insertable in the recess in the rest position.

10 Claims, 3 Drawing Sheets

FILLING MACHINE WITH SEALING VALVE

TECHNICAL FIELD

The present invention relates to a filling machine and in particular to a filling machine for filling a product into packaging containers.

BACKGROUND

When filling product into packaging containers there are several different approaches to consider, and in many approaches packaging containers are filled using a filling nozzle through which the product is ejected into the packaging container. There are instances where it may be beneficial to dish and sterilize the filling nozzle and associated fluid passages without affecting the rest of the filling machine. In such a situation there are examples of a cup-like arrangement being arranged to enclose and outlet end of the filling nozzle. The present invention aims at providing a filling machine having a new and improved arrangement for isolation of the filling nozzles.

A sealing system according to the preamble of the present invention is disclosed in U.S. Pat. No. 4,534,494.

SUMMARY

Some of the above and other objectives are reached by means of a filling machine for filling product into a packaging container comprising, at least one filling nozzle for ejection of liquid in a first general direction into the packaging container, wherein the filling nozzle is arranged in a dishbox having an opening through which the product may be ejected towards a package provided in a volume. The filling machine is characterized in that the opening may selectively be sealed by a sealing valve. The use of selective sealing of the opening is beneficial in that it facilitates cleaning or sterilization of the filling nozzles separable from the cleaning or sterilization of the volume in which the packaging containers are available. Also, the use of steam for sterilization purposes is enabled due to the possibility of elevating the pressure in the area of the filling nozzles due to the confinement defined by the dishbox and the sealing valve.

In one or more embodiments the sealing valve may be movable in the said first general direction and perpendicular to said first general direction between a use position and a rest position. This enables for the sealing valve to be moved out of the way in more than one direction, such that surfaces concealed by the sealing valve in one position, may be exposed in another position.

In one or more embodiments the sealing valve may comprise a valve body having a portion dimensioned to be inserted in said opening, such that the opening may be readily sealed. The use of an insertable valve body enables non-complex design, which is an advantage in several ways, not the least since it may provide a surface which is easier to clean or sterilize.

According to one or several embodiments a recess may be provided in an upper surface of the filling machine, dimensioned such that the valve body is at least partly insertable. This feature is particularly beneficial since it allows for at least part of the valve body to be concealed from exposure during filling of packaging containers. The effective diameter of the opening may also be smaller than the effective diameter of the recess, referring to the diameter of engagement with the valve body. This feature ensures that the part of the valve body being exposed towards the filling nozzles in the use position has not been exposed the atmosphere inside the volume with the packaging containers during filling of said containers. It also implies that there is no area of the valve body that is concealed in both the use position and the rest position of the sealing valve, meaning that the entire surface area of the valve body may be cleaned or sterilized.

One mechanism that may be used for operation of the sealing valve is that the valve body may coupled to a turning shaft extending from an annular channel in an upper surface of the volume, wherein sealing means are arrange to provide a seal between the turning shaft and said channel when the valve body is positioned in the recess. A turning shaft is a suitable means for operating the sealing valve, since it relatively easily allows for movement in the direction of the turning shaft by displacing the same along its axis of rotation, and obviously around the axis of rotation as well. The sealing means may be arranged such that it is only abutting (and thereby effecting a seal) when the sealing body is situated in the recess. In this way the inevitable clearance around the turning shaft as it extends into the annular channel, which prevents any product deposition in these hard to reach crevices and clearances during filling of packaging containers.

In one or more embodiments the turning shaft may comprise individual projections abutting the inner wall channel, said projections being distributed around the circumference of the shaft. The projections enables for the turning shaft to be arranged in the annular channel with small clearances, to the benefit of the operation of the sealing valve. At the same time the space between the individual projections enables a flow of gas or cleaning/sterilization agent along the annular channel, during cleaning/sterilization thereof.

DESCRIPTION OF EMBODIMENTS

Figure 1:
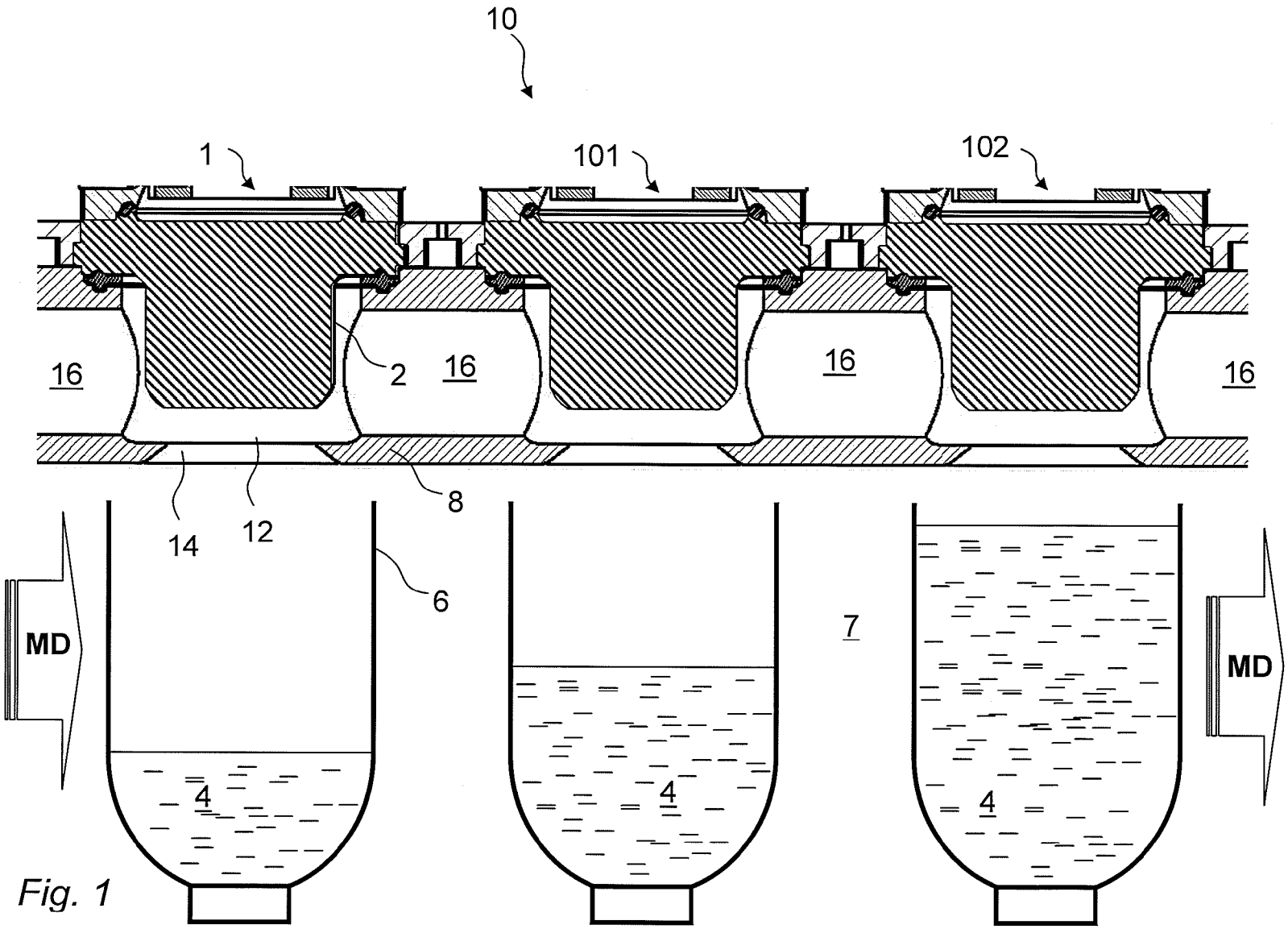
FIG. 1 is a schematic cross section of a filling station.

For better understanding of the context of the present invention a brief introduction is provided referring to FIG. 1. FIG. 1 is a partial schematic cross sectional view of a filling assembly 1 including a nozzle head 2 (or filling nozzle). The nozzle head receives pourable product 4 from above and ejects it into the packaging containers 6 below. The packaging containers are generally situated on a conveyer system (not shown), which conveys them through the chamber 7. The filling assembly 1 is attached to an arrangement for enclosing the nozzle head 2 in the form of a dish box 8 to form a filling unit. The illustrated assembly is part of a filling station 10 of a filling machine or packaging machine for filling pourable food stuff into packaging containers, said filling station 10 comprising three filling assemblies. The packaging containers 6 have been sterilized prior to filling, and maintenance of aseptic conditions in the chamber 7 until the packaging containers 6 have been filled and sealed is a paramount issue in this context. The filling unit, with its large interior surface area therefore has to be cleaned and sterilized on a regular basis. If the unit is arranged in an aseptic environment, the cleaning and sterilization should preferably be performed without disturbance of the aseptic conditions. Disassembling the unit for cleaning and sterilization would be cumbersome, time consuming and would require a reassembly performed under aseptic conditions, and is therefore not desired. For this reason a dish box 8 is arranged. The dish box 8, a portion of which is shown in FIG. 1, comprises vertical through holes 12, in which the nozzle head 2 may be inserted with a clearance. The through holes 12 may comprise a first portion having a first diameter, followed by a second portion having another diameter, i.e. the opening 14 in the dish box 8, to be described. The dish box 8 also comprises a horizontal channel 16, interconnecting all vertical through holes 12. Not shown in the drawing are blocking or sealing valves that may be controlled to seal the openings 14 of the dish box 8 from below. The construction and function of a sealing valve will be described in more detail referring to FIGS. 2-6. The pourable product 4 have to pass these openings 14 in order to reach the packaging container 6 below, and by sealing off the openings 14 the filling station may be separated from the rest of the filling machine. To facilitate the sealing it is beneficial if the openings 14 are as small as possible. Also, smaller opening 14 enables a smaller distance between adjacent filling assemblies 1, which in turn may enable shorter indexing steps when moving packaging containers 6 through the machine, and an increased production rate. Smaller openings 14 further enables less bulky mechanics for the blocking means. After sealing, the filling unit may be cleaned/dished, sterilized by hydrogen peroxide, pressurized steam or by other means, flushed with a mixture of peracetic acid etc, without affecting the rest of the filling machine.

It is obvious to the skilled person that automated sealing valves will require mechanics, and any mechanics inside the aseptic area will provide crevices etc for the impurities to reside. One aspect of the present invention is to reduce the number of available crevices, which in turn will result in a more reliable cleaning and sterilization process and thus facilitate aseptic conditions.

Figure 2:
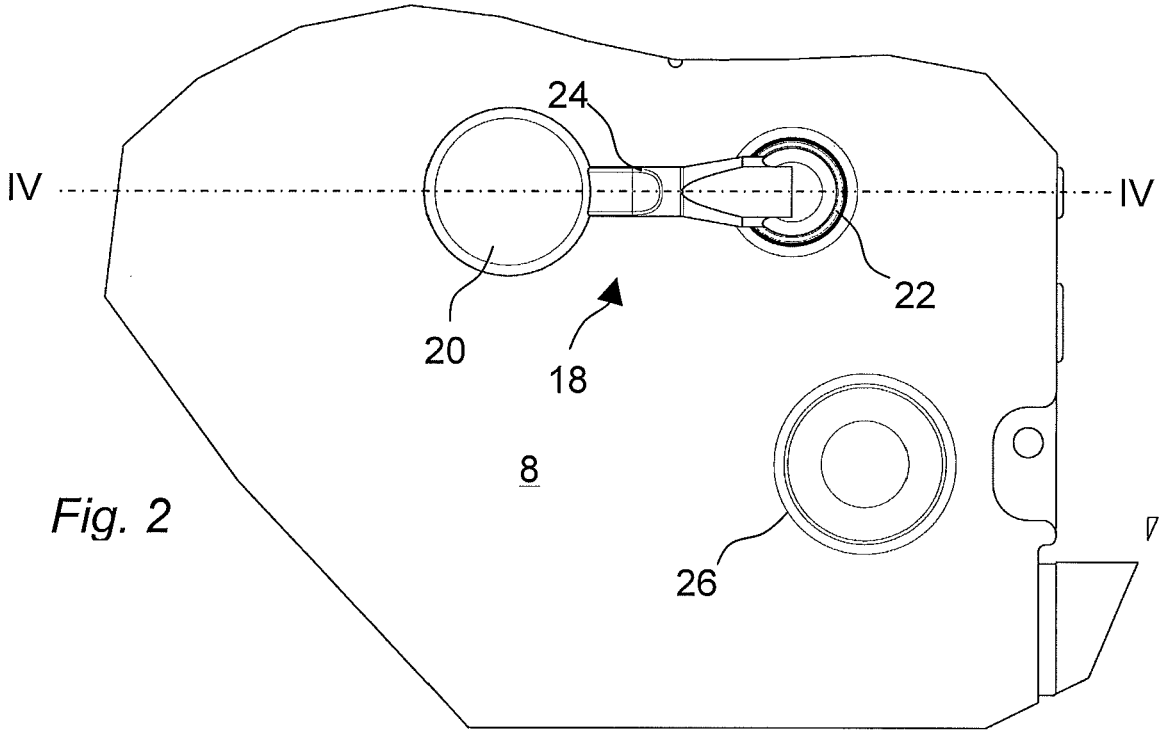
FIG. 2 is a view from below of a portion of an inventive filling machine according to one embodiment thereof.

FIG. 2 is a view from below shown a sealing valve 18 having valve body 20 coupled to a turning shaft 22 via connection rod 24. The valve body 20 as a portion being insertable into the opening 14. Further, the turning shaft 22 may rotate around its central axis C (see e.g. FIG. 4) and is movable along said central axis. In this way the valve body 20 may be move into and out of engagement with the opening 14 to seal it or allow passage of pourable product. The valve body 20 is thus movable along a circumference defined by the length of the connection rod 24. The turning shaft 22 also has a number of projections 23 (see e.g. FIG. 4) distributed around its circumference at a lower end thereof. The purpose of the projections 23 (which looks like a circumferential bead in the cross section of FIGS. 4-6) is to guide the turning shaft 22 and thus the valve body 20, while still allowing passage of dishing or sterilization agents. These may pass up or down the annular slit around the turning shaft 22 and out or in through the passage 25 (see FIGS. 4-6). Another purpose of the projections 23 is to absorb any moment resulting from the valve body 20 being pressed towards the rim of the opening 14.

At one position on the circumference along which the valve body 20 may move a recess 26 is arranged in the filling machine, essentially in the bottom exterior surface of the dishbox 8. The design of the recess 26 is such that it matches the shape of the valve body 20, such that the latter may be arranged in the former, e.g. in a rest position for the sealing valve 18. Further, the diameter where the recess 26 abuts the valve body 20 may be larger than the corresponding diameter for the opening 14. In this way the part of the valve body 20 being exposed inside the dish box 8 as the valve body 20 is arranged in the opening 14 will always be free from residues. Also, it is beneficial to have two different abutment diameters since it will result in that all areas are cleaned/dished/sterilized.

Figure 3:
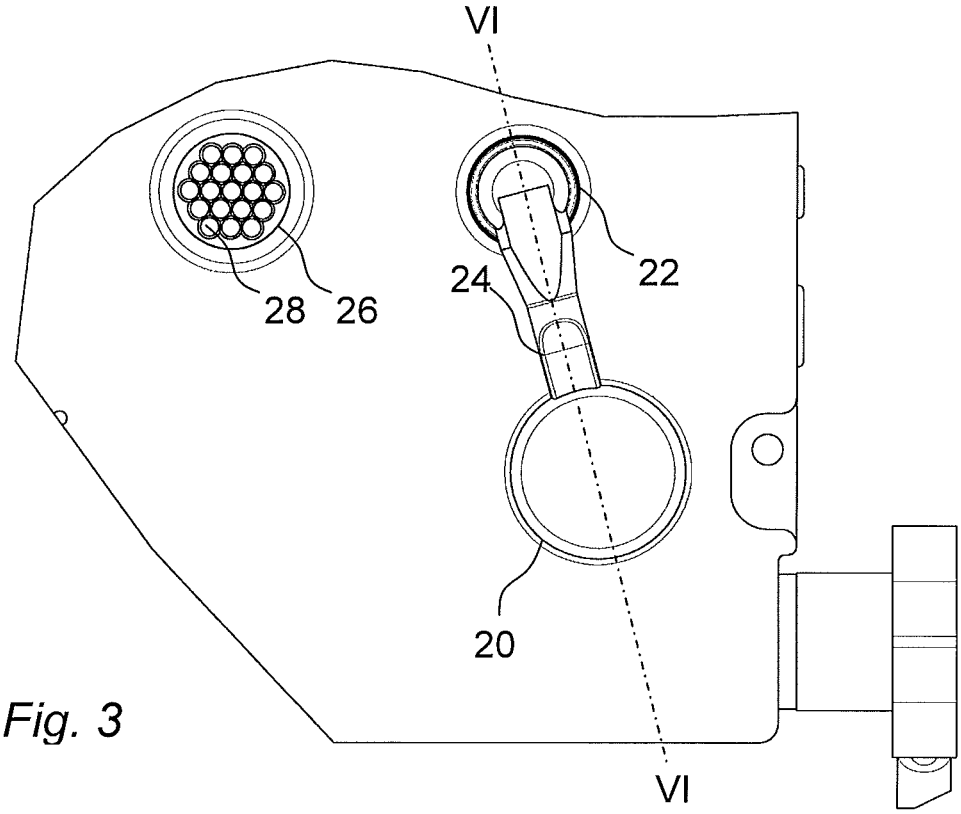
FIG. 3 is a view from below according to FIG. 2 with the sealing valve in an alternative position.

FIG. 3 is a view similar to that of FIG. 2 illustrating the sealing valve 18 in the rest position. In FIG. 3 the previously obscured opening 14 is visible and also ejection openings 28 of the nozzle head 2 are shown. Like elements have been given like numerals.

Figure 4:
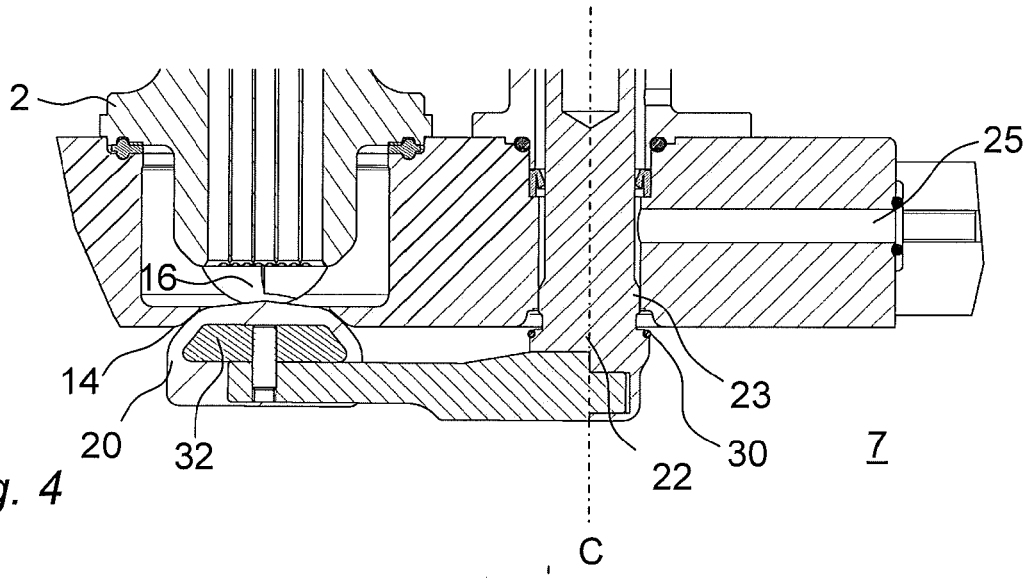
FIG. 4 is a cross section along the line IV-IV of FIG. 2.
Figure 5:
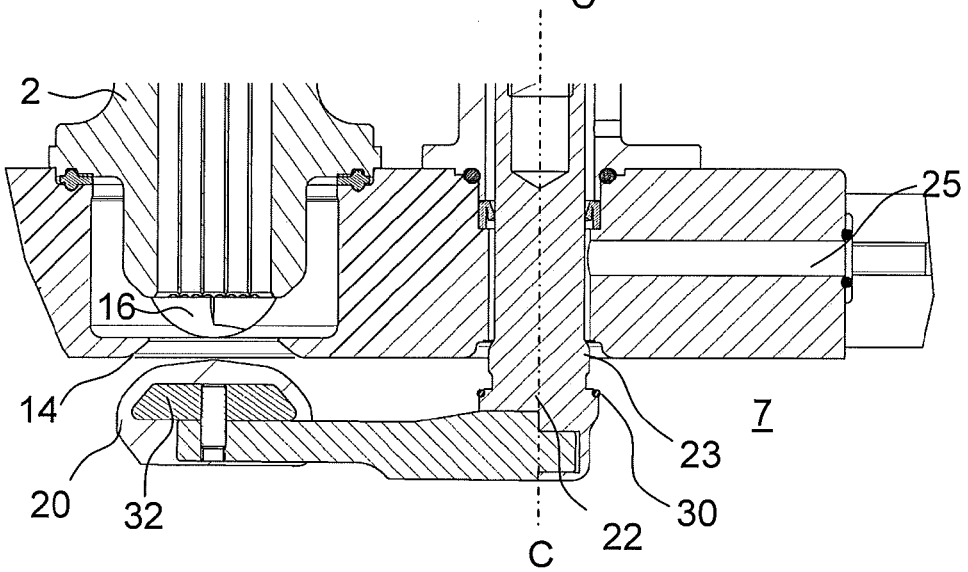
FIG. 5 is a cross section according to FIG. 4 with the sealing valve in a lifted position.

FIG. 4 is a cross section along the line IV-IV of FIG. 2, which will be used to describe the construction of the sealing valve 18 in some more detail. First, and in order to guide the reader: The nozzle head 2 and its interior channels for directing pourable product are shown. Also the dish box 8, the horizontal channel 16 and the opening 14 are shown. In relation to the sealing valve 18 it is apparent from FIG. 4 that the valve body 22 comprises an interior support structure 32 attached to the connection rod 24, which has been overmoulded or in any other way provided with a resilient cover, such as with some sort of rubber compound or other compound suitable for the objective. The properties of the valve body 22 are adequate for obtaining a seal towards the rim of the opening 14 as well as towards the rim of the recess 26. The support structure 32 may be made from stainless steel of adequate quality. It should be noted that in the position of FIG. 4 sterilizing or cleaning agent may still pass along the annular slit around the turning shaft 22 and in or out through the passage 25, thanks to the projections 23 and the channels formed there between. The points where the projections abut the interior walls of the turning-shaft channel will, however, be hard to reach during cleaning or sterilizing. They are however exposed in the position illustrated in FIG. 5, whereby a full clean/sterilization of all surfaces may be performed.

In the position of FIG. 4 the filling system upstream the opening 14 may be cleaned, and sterilized e.g. using steam. In the same position the filling machine downstream the opening may be cleaned, and sterilized e.g. using a sterilization gas.

Figure 6:
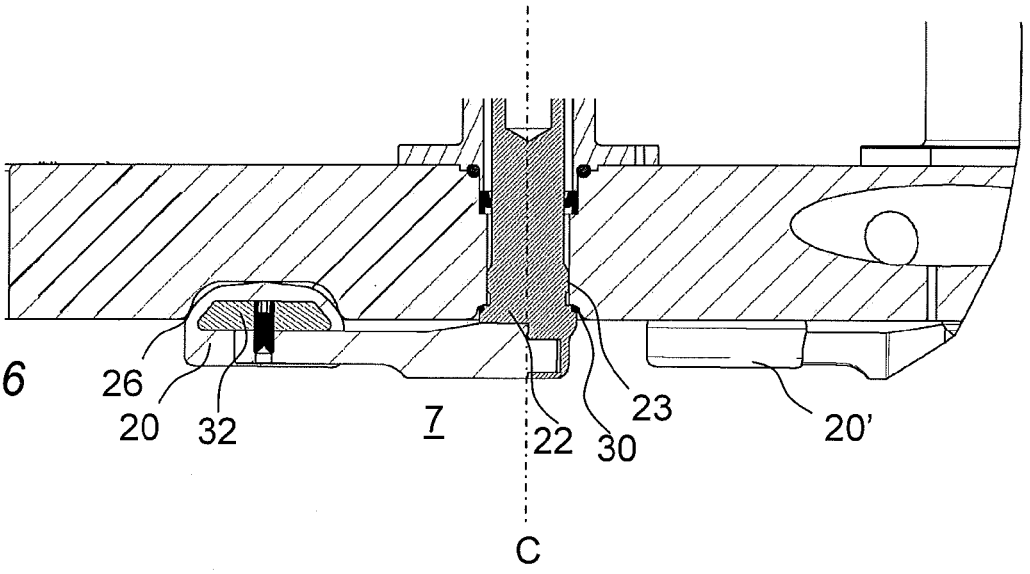
FIG. 6 is a cross section along the line VI-VI of FIG. 3.

The use of a recess 26 or "dummy opening" as shown in e.g. FIG. 6 has the benefit of locating the sealing valve in the rest position, but more importantly, it facilitates sealing of crevices around the turning shaft 22 in a straightforward and simple manner. As mentioned before, the diameter D of the recess 26 may preferably be larger than the diameter d of the opening 14. The relevant diameter is the diameter for the circumference where the valve body 20 abuts the opening or recess. Further, by having the recess 26 dimensioned to allow for the valve body 20 to be inserted further than what is the case when it is inserted in the opening 14 enables use of sealing means not active during sealing of the opening 14. In the present embodiment an O-ring 30 is used as sealing means and is arranged around the shaft 22 for sealing of the crevices inevitably present where the shaft 22 extends through the top of the chamber 7. The O-ring or seal 30 is vulcanized to the shaft 22 in order to prevent contaminants from entering between the seal 30 and the turning shaft 22. By not allowing contaminants to access hard to reach areas the cleaning/sterilization is simplified and may be performed with an improved result. FIG. 6 also illustrates an adjacent sealing valve 20'. In the rest position of FIG. 6 the machine is in production mode. The volume above the O-ring is protected from product splashes and there may be a slight under pressure in the channel 25 to prevent contaminated air from entering the aseptic volume 7.

In the rest position for the sealing valve 18, i.e. when the filling machine is in use, product splashing out of the packaging container 6 as a result from the filling procedure may occur. Such splashing will not be able to reach the crevices, which in turn simplifies the maintenance of aseptic conditions in the chamber 7. It should be noted that splashing is not the only polluting process in a filling machine. During filling of packaging containers an aerosol of product will be generated, which may adhere to the exposed surfaces, also particles emanating from the packaging material may be present in the atmosphere inside the chamber and adhere to surfaces thereof.

It should be noted that the first aspect of the present invention, namely the relationship between the sizes of the valve body, the opening, and the recess, respectively, provides a base for enabling the second aspect of the present invention, namely the sealing of the drive means for the for the valve. The two aspects offer partial solutions to the same problem; the enablement of full cleaning and sterilization of a filling machine.

The invention claimed is:

1. A filling machine for filling product into a packaging container comprising:

at least one filling nozzle for ejection of liquid in a first general direction into the packaging container, wherein the filling nozzle is arranged in a dishbox having an opening through which the product is ejectable towards a package provided in a volume, the dishbox possessing a lower surface facing the volume, the opening being selectively sealable by a sealing valve having a valve body with a portion dimensioned to be inserted in said opening to seal the opening, and a recess in the lower surface of the dishbox such that the valve body is at least partly insertable into the recess in the lower surface of the dishbox to abut against the recess when the sealing valve is in a rest position during filling of the product into the packaging container.

2. The filling machine of claim 1, wherein an effective diameter of the opening is smaller than the effective diameter of the recess, referring to a diameter of engagement with the valve body, such that a part of the valve body exposed towards the filling nozzles in a use position has not been exposed to atmosphere inside the volume when in the rest position.

3. The filling machine of claim 1, wherein the sealing valve is movable in a first general direction and perpendicular to said first general direction between a use position and the rest position.

4. The filling machine of claim 1, wherein the valve body is coupled to a turning shaft extending from an annular channel in the dishbox, and further comprising sealing means for sealing between the turning shaft and said channel when the valve body is positioned in the recess.

5. The filling machine of claim 4, wherein the turning shaft comprises individual projections abutting the inner wall channel, said projections being distributed around the circumference of the shaft.

6. The filling machine of claim 1, wherein the valve body comprises a resilient cover.

7. The filling machine of claim 4, wherein the sealing means are vulcanized to the turning shaft.

8. The filling machine of claim 5, wherein the projections are arranged at a lower end of the turning shaft and are configured to allow passage of dishing or sterilizing agents.

9. A valve arrangement for sealing an opening in a dishbox of a filling machine relative to a volume in which packages to be filled may be arranged, said system comprising:

a sealing valve having a valve body for sealing the opening;

the dishbox possessing a lower surface facing the volume, the lower surface including a recess; and the valve body being at least partly insertable into the recess in the lower surface of the dishbox to abut against the recess when the sealing valve is in a rest position during filling of the product into the packaging container.

10. A valve arrangement for sealing an opening in a dishbox of a filling machine relative to a volume in which packages to be filled may be arranged, said system comprising:

a sealing valve having a valve body for sealing the opening;

the valve body being at least partly insertable in a recess arranged in a lower surface of the dishbox; and wherein the valve body is coupled to a turning shaft extending from an annular channel in the dishbox, further comprising sealing means for sealing between the turning shaft and the channel when the valve body is positioned in the recess, the sealing means having one state in which the opening is sealed by the valve body while the annular channel is open and another state in which the valve body is arranged in the recess and the sealing means provides a seal between the turning shaft and the channel.

* * * * *